US006092654A

United States Patent [19]

Webb

[11] Patent Number: 6,092,654

[45] Date of Patent: Jul. 25, 2000

[54] PACKAGE FOR A PRODUCT HAVING A LATERALLY DIRECTED BASE

[75] Inventor: Peter W. Webb, New Haven, Mo.

[73] Assignee: Innovative Enterprises, Inc., Washington, Mo.

[21] Appl. No.: 09/388,850

[22] Filed: Sep. 2, 1999

[51] Int. Cl.[7] ..... B65D 85/68; B65D 85/20; B65D 81/05

[52] U.S. Cl. ..... 206/320; 206/319; 206/446; 206/521; 206/586; 206/588

[58] Field of Search ..... 206/319, 320, 206/525, 521, 587, 588, 592, 446, 586

[56] References Cited

U.S. PATENT DOCUMENTS

| | | | |
|---|---|---|---|
| 1,817,286 | 8/1931 | Beaman | 206/586 |
| 2,321,063 | 6/1943 | Bohnke | 206/320 |
| 2,575,784 | 11/1951 | Barmann | 206/320 |
| 2,932,438 | 4/1960 | Smith | 206/587 X |
| 2,936,880 | 5/1960 | Kohlhaas | 206/320 |
| 3,161,339 | 12/1964 | Weller | 206/521 |
| 4,375,261 | 3/1983 | Kitchell | 206/320 |
| 5,361,900 | 11/1994 | Stringer et al. | 206/319 |
| 5,407,077 | 4/1995 | Sinclair, Sr. | 206/586 |
| 5,590,786 | 1/1997 | Jaycox | 206/587 |
| 5,743,393 | 4/1998 | Webb et al. . | |

*Primary Examiner*—Bryon P. Gehman
*Attorney, Agent, or Firm*—Polster, Lieder, Woodruff & Lucchesi, L.L.C.

[57] ABSTRACT

A package for a compressor having a base to which a shell is attached includes a box having side walls and also a bottom wall and a top wall formed from overlying flaps. In addition, the package includes a rigid base formed from overlying panels of slab-like paperboard material. The panels fold relative to each other, and the upper of the two panels contains a cutout which enables that panel to pass over the compressor shell, or over the compressor base, to a position overlying the compressor base. Once the upper panel is over the compressor base, the lower panel is folded under the compressor base so that the compressor base is captured between the two panels of the package base. In this condition the compressor and the package base are inserted into the box. The package base comes to rest against the bottom wall of the box. A sleeve fits around the shell of the compressor and extends between the upper panel of the package base and the upper wall of the box. A tray fits into the upper end of the sleeve between the top of the compressor shell and the top wall of the box. A honeycomb ring surrounds the sleeve between its ends and projects laterally out to the side walls of the box.

25 Claims, 5 Drawing Sheets

PACKAGE FOR A PRODUCT HAVING A LATERALLY DIRECTED BASE

CROSS-REFERENCE TO RELATED APPLICATIONS

STATEMENT REGARDING FEDERALLY SPONSORED RESEAREH OR DEVELOPMENT

Not Applicable.

BACKGROUND OF THE INVENTION

This invention relates in general to packaging and more particularly to a package for a product having a laterally directed base and to a method of packaging such a product.

Some manufactured products, which function as components of other manufactured products, occupy relatively little space, yet are quite heavy. When sold to manufacturers of original equipment, these component products are traditionally shipped in bulk containers designed to accommodate them. But a significant aftermarket exists for these component products as well, and when sold in the aftermarket, these component products require individual packaging. Compressors for residential and light commercial air-conditioning systems represent a typical component product. They are manufactured separately from the condenser units in which they are ultimately installed, and while a compressor occupies relatively little space, it is quite heavy, generally weighing from 50 to 100 pounds.

The typical compressor has a hermetically sealed shell which contains the actual compressor mechanism and an electric motor for driving it. The shell is attached to a stamped metal base that projects laterally beyond the shell. When sold for the aftermarket, the compressor is often furnished in a corrugated paperboard box. However, corrugated paperboard will not support a heavy compressor without considerable reinforcement. In traditional packaging, that reinforcement resides primarily in a package base on which the compressor rests. Typically, the package base is formed from plastic or plywood or oriented strand board (OSB).

Packaging for a compressor must pass rigorous tests before compressor manufacturers will accept it. One of the tests involves dropping the package with the heavy compressor in it from a height of one foot ten times such that the package lands on a different corner and exterior panel on each drop, all without inflicting damage on the compressor. Packages containing traditional bases formed from plastic, plywood or oriented strand board have not fared well in these tests. Moreover, packages containing traditional bases are expensive and time consuming to assemble in that they require nuts, bolts and washers for fasteners.

Other packaging contains large quantities of cushioning formed from expanded plastic (plastic foam). This material is not easily recycled and does not degrade in land fills, as does the corrugated paperboard, and is not desirable from that standpoint.

BRIEF SUMMARY OF THE INVENTION

The present invention resides in a package for enclosing a product having a body and a base that projects laterally beyond the body. The package includes a box having side walls, a bottom wall and a top wall. It also includes a rigid base which fits into the bottom of the box with the base of the product captured in it. In addition, the package has a sleeve which fits around the body of the product and extends from the package base to the top wall of the box, thus holding the package base in the bottom of the box. The invention also resides in the method of packaging such a product.

The invention also consists in the parts and in the arrangements and combinations of parts hereinafter described and claimed.

BRIEF DESCRIPTION OF THE SEVERAL VIEWS OF THE DRAWINGS

In the accompanying drawings which form part of the specification and wherein like numerals and letters refer to the like parts wherever they occur.

Corresponding reference numerals will be used throughout the several figures of the drawings.

DETAILED DESCRIPTION OF THE INVENTION

Figure 1:
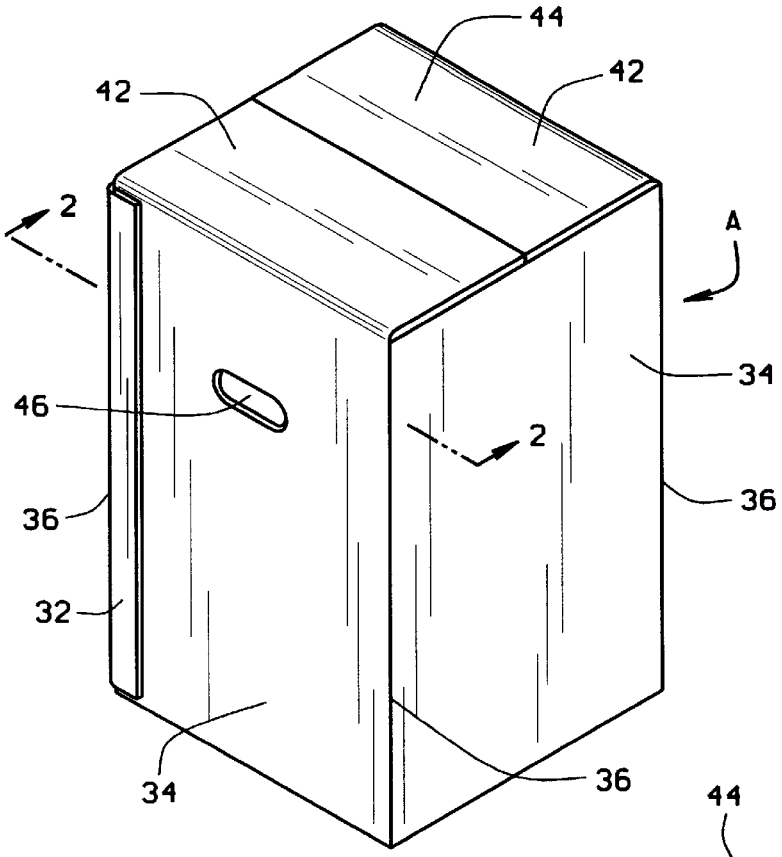
FIG. 1 is a perspective view of a package constructed in accordance with and embodying the present invention.

The following detailed description illustrates the invention by way of example and not by way of limitation. This description will clearly enable one skilled in the art to make and use the invention, and describes several embodiments, adaptations, variations, alternatives and uses of the invention, including what is presently believed to be the best mode of carrying out the invention.

Referring now to the drawings, a package A (FIGS. 1–3) contains a heavy, yet compact product, such as a compressor B for use in a condenser unit of a residential or light commercial air-conditioning system. The compressor B includes (FIG. 5) a body in the form of a steel shell 2 formed from sections which are joined together to encase all of the working components of the compressor B, thus forming a hermetically sealed unit. The shell 2 is attached to a base 4 which projects laterally beyond the shell 2. In the typical condenser unit the base 4 rests on springs or rubber grommets that in turn rest on a housing where they are held in place with bolts, thus enabling the compressor B to operate without imparting excessive vibrations to the unit housing. The compressor B also has electrical junction box 8 mounted on the side of the shell 2 from which it projects, and two copper tubes 10 and 12 that emerge from the side of the shell 2, the former being above the latter, for receiving and discharging a refrigerant.

The package A includes a box 20 of six-sided configuration that is large enough to completely enclose the compressor B, a package base 22 which fits into the box 20 at the bottom of the box 20 to support the compressor B, a sleeve 24 which fits into the box 20 and around the shell 2 of the compressor B where it extends upwardly from the package base 20 to the very top of the box 20, a tray 26 that fits into the sleeve 24 at the upper end of the sleeve 24, and a ring 28 which fits around the sleeve 24. The package A confines the compressor B both laterally and vertically and serves to protect the compressor B from damage.

Figure 2:
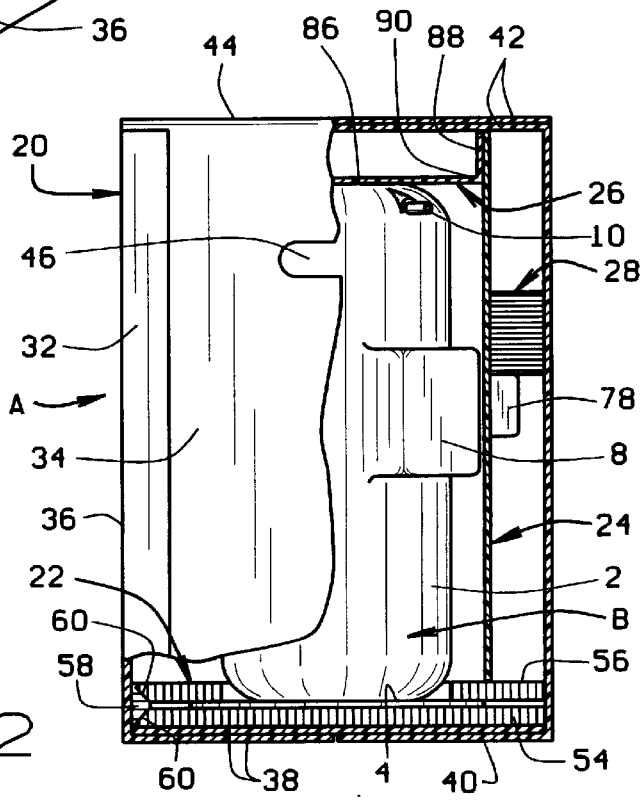
FIG. 2 is a side elevational view of the package, partially broken away and in section, to show a compressor within it.
Figure 3:
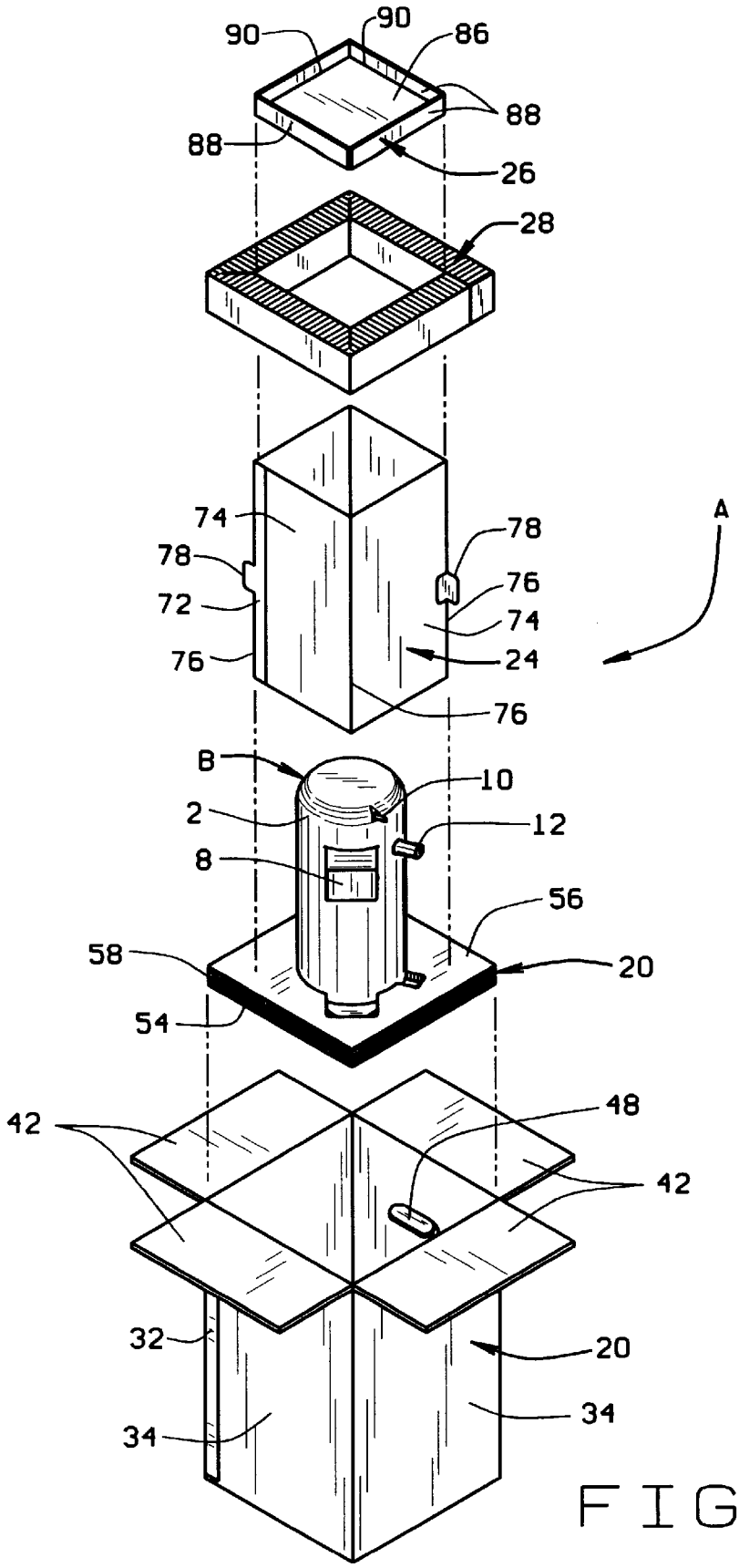
FIG. 3 is an exploded perspective view of the package.

The box 20 is formed from a blank that is cut from double wall corrugated paperboard, that is paperboard which consists of three essentially flat sheets of paper separated by two corrugated sheets of paper. The blank is folded into a tubular configuration and retained in that configuration by a manufacturer's joint 32 (FIGS. 1–3). Even when so retained, the box 20 may assume a knocked down condition in which it lies essentially flat. But it is easily converted into a configuration suitable for receiving the compressor B. The box 20 when erected has four vertical side walls 34 which are joined together at right angle corners 36. The manufacturer's joint 32 lies along one of the corners 36 and holds the adjacent side walls 34 at that corner 36 together. Each side wall 34 at its bottom margin has a flap 38 joined to it, and the flaps 38 turn inwardly from their respective side walls 34 where they overlap and are joined together in the conventional manner to form a bottom wall 40. Each of the side walls 34 along its upper margin has another flap 42 joined to it, and the flaps 42 are initially spread outwardly and otherwise detached to provide access to the interior of the box 20. Once the box 20 is loaded with the compressor B along with the base 22, the sleeve 24, the tray 26 and the ring 28, the upper flaps 42 are folded over onto each other and secured in the conventional manner to form a top wall 44 which closes the upper end of the box 20.

In two of its side walls 34, the box 20 has elongated openings 46 that are initially occupied by tabs 48 (FIG. 3), but the tabs 48 fold inwardly along the upper margins of the openings 46 and into the interior of the box. The openings 46, which have their major axes extended horizontally, serve as hand holds for the package A, enabling one to conveniently grip the package A simply by pushing the tabs 48 inwardly and placing one's hands in the openings 46 so provided.

Figure 4:
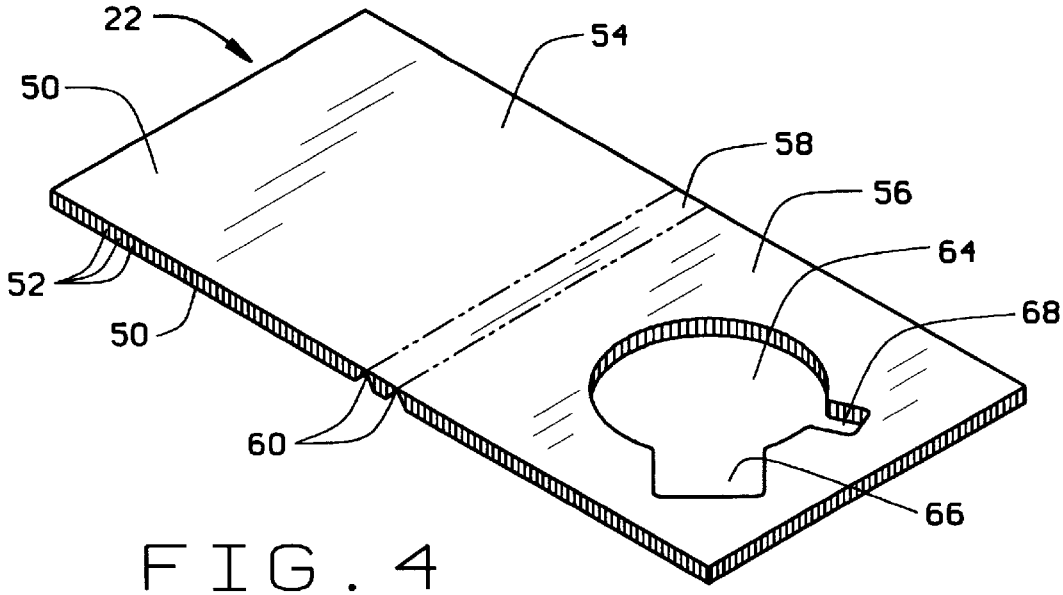
FIG. 4 is a perspective view of the package base in its open condition.
Figure 5:
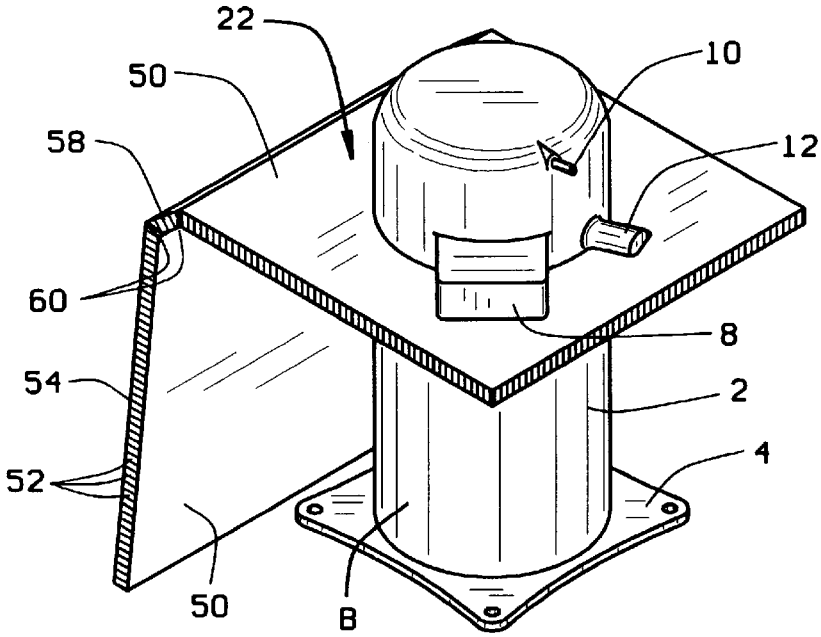
FIG. 5 is a perspective view of the compressor with the package base being fitted to it.

The package base 22 fits snugly within the bottom of the box 20 so that it cannot shift laterally between the side walls 34 of the box 20 (FIG. 2). It is formed from a generally rigid, yet lightweight, slab material that is capable of supporting the compressor B without crushing. Preferably, the slab material consists of paper facer sheets 50 which are parallel, yet spaced apart, and intervening paper sheets 52 interposed between the facer sheets 50 where they are oriented perpendicular to the facer sheets 50 (FIGS. 4 and 5). The intervening sheets 52, which are alternatively flat and corrugated, are joined with glue to the facer sheet 50 at their end edges. The slab material can withstand compressive stresses of considerable magnitude when those stresses are applied perpendicular to the facer sheets 50. A slab material suitable for the package base 22 is available from North American Container Corporation of Smyra, Ga., which sells it under the trademark FIBRE/CORE. Paper honeycomb material also has facer sheets separated by intervening sheets oriented perpendicular to the facer sheets and will suffice for the slab material of the package base 22 where the compressor B is relatively light in weight.

While being formed from a single slab of generally rigid material, the base 22 has three panels—lower panel 54, an upper panel 56, and an intermediate panel 58 which is connected to the ends of the lower and upper panels 54 and 56 at V-score joints 60 to enable the panels 54, 56 and 58 to fold easily relative to each other (FIGS. 4 and 5). The lower panel 54 of the package base 22 rests on the bottom wall 40 of the box 20, and the upper panel 56 lies directly over it (FIG. 2). The intermediate panel 58 extends vertically between the ends of the lower and upper panels 54 and 56 and lies along one of the side walls 24 of the box 20. The V-score joints 60 accommodate the folding. To this end, the facer sheet 50 at the inside of the fold is severed along the joints 60 and the underlying alternating flat and corrugated sheets 52 are crushed to create V-shaped depressions when the panels 54, 56 and 58 are open or unfolded.

The upper panel 56 of the package base 22 contains a cutout 64 (FIG. 5) which is generally circular and only slightly greater in diameter than the shell 2 of the compressor B, so that the panel 56 fits easily over the shell 2. The cutout 64 has a large radially directed portion 66 which conforms to the shape of the junction box 8 and small radially directed portion 68 which conforms to the shape of the lower or larger copper tube 12. Actually, the portions 66 and 68 are slightly larger than the junction box 8, and the tube 12, and the angular orientation between them corresponds to the actual angular orientation between the junction box 8 and the tube 10 on the compressor B. Thus, the panel 56 not only fits over the shell 2 of the compressor B, but also over the junction box 8 and tube 10 as well (FIG. 5). Once the panel 56 clears the junction box 8 of the compressor B, it will drop all the way to the base 4 of the compressor B, whereupon the lower panel 54 is folded beneath the upper panel 56, the two panels 54 and 56 articulating with respect to each other at the joints 60 (FIGS. 3 and 5). But the base 4 projects laterally from the shell 2 and will not pass through the cutout 64. As a consequence, it lies captured between the upper and lower panels 54 and 56 of the container base 22. Indeed, once the container base 22 is installed over the shell 2 of the compressor B and folded under the compressor base 4, the package base 22 and the compressor B are lowered as a unit into the box 20 until the lower panel 54 of the package base 22 comes to rest on the bottom wall 40 of the box 20.

Initially, the sleeve 24 exists as a blank that is preferably formed from double wall corrugated paperboard, but the blank is folded over onto itself and its ends are joined at a manufacturer's joint 72, thus producing a tubular configuration having four side walls 74 connected at corners 76 (FIG. 3). The side walls 74 are equal in width and height, with the width being only slightly greater than the diameter of the shell 2 and the height corresponding to the distance between the upper panel 56 of the base 22 and the top wall 44 of the box 20. Normally, at each corner 76 the walls 74 which meet at that corner 76 are oriented at 90° with respect to each other, but the sleeve 24, like the box 20, may be folded into a compact knocked-down condition for shipping. The sleeve 24 is installed in the box 20 after the package base 22 and compressor B, simply by lowering it downwardly over the shell 2 of the compressor B. When so installed, the walls 74 of the sleeve 24 lie parallel to the side walls 34 of the box 20, but of course are set inwardly from those side walls 34. Preferably, the compressor B is oriented such that its junction box 8 projects toward one of the corners 36 of the box 20 and likewise into one of the corners 76 of the sleeve 34.

At each of two corners 76 for the sleeve 24, a tab 78 (FIG. 3) projects from the corner 76 to serve as a stop for preventing the ring 28 from migrating toward the package base 22. To this end, one of the two side walls 74 that meets at the corner 76 extends laterally beyond the other side wall 74 in the form of the tab 78. The tab 78 itself derives from the other side wall 74, leaving a cutout in that other side wall 74.

The tray 26 serves to rigidify the upper end of the sleeve 24. It also provides a receptacle for accessories and instructional materials. To this end, the tray 26, which is preferably formed from double wall corrugated paperboard, has a rectangular center panel 86 which corresponds in shape and size to the interior of the sleeve 24 and flaps 88 which project upwardly from the center panel 86 along V-shaped scores 90 (FIGS. 2 and 3). The center panel 86 occupies the interior of the sleeve 24 immediately above the compressor B, while the flaps 88 lie along the side walls 74 of the sleeve 24. Indeed, the flaps 88 extend up to the top wall 44 of the box 20 which prevents the tray 26 and the compressor B from rising in the sleeve 24, whereas the compressor B prevents the tray 26 from descending in the sleeve 24.

Figure 8:
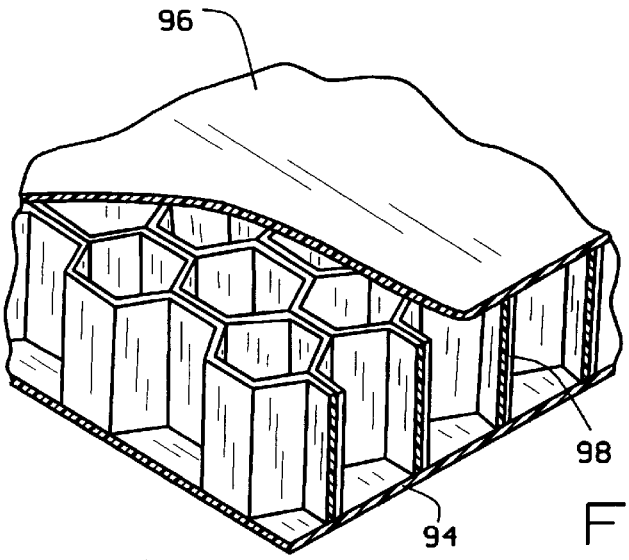
FIG. 8 is a fragmentary perspective view, partially broken away and in section, of the ring.

The ring 28 fits around the sleeve 24 (FIG. 3) and prevents the sleeve 24 from tipping toward any one of the side walls 34 of the box 20 under the weight of the compressor B. The ring 28 is preferably formed from a paper honeycomb material having spaced apart facer sheets 94 and 96 and honeycomb cells 98 interposed between the facer sheets 94 and 96 with their axes oriented perpendicular to the facer sheet 94 and 96 and the honeycomb cells 98 are formed from paper and the sheets 94 and 96 and the cells 98 are joined firmly together with glue. (FIG. 8).

Figure 6:
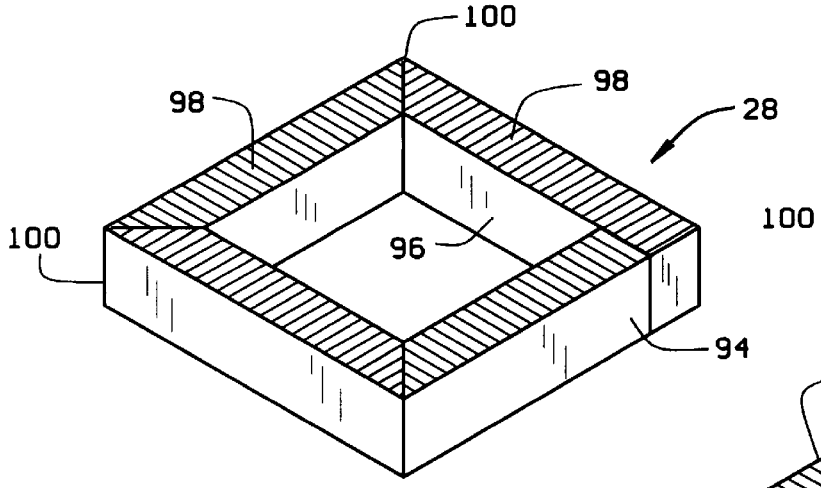
FIG. 6 is a perspective view of the ring forming part of the present invention.
Figure 7:
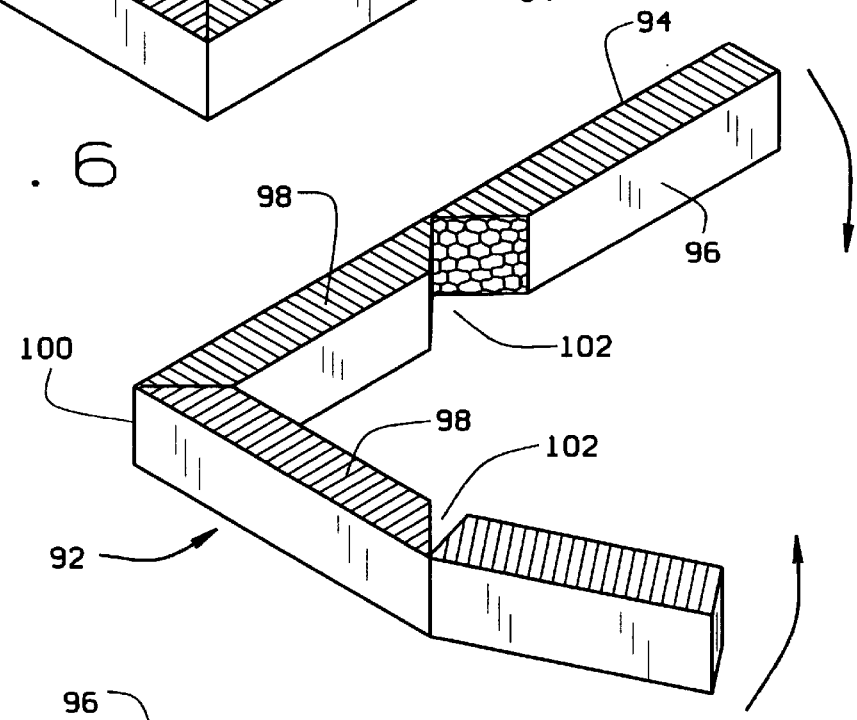
FIG. 7 is a perspective view of the strip of slab material from which the ring is derived, with the strip being partially folded.

The thickness of the honeycomb material that is to say, the distance between its two facer sheets 94 and 96, generally equals the spacing between the side walls 74 of the sleeve 24 and the side walls 34 of the box 20. The honeycomb material folds and closes upon itself with its two ends adjacent to become the ring 28, with the folds forming corners 100 in the ring 28 (FIGS. 6 & 7). Paper honeycomb normally possess considerable rigidity, so in order to accommodate the folds the inside facer sheet 96 and the honeycomb cells 98 are cut at each location at which a corner 100 is desired. Moreover, the honeycomb cells 98 are crushed at those locations, with the cuts providing V-shaped depressions 102 that opens out of the inside facer sheet 96 in the strip 92. While the inside facer sheet 96 is severed at the depressions 102, the outside facer sheet 94 remains intact throughout the length of the honeycomb 92, and at each depression 102 serves as a hinge for providing the corners 100. Indeed, to create the ring 28, the honeycomb is simply folded along its outside facer sheet 94 at the depressions 102, with the folds being in the direction which brings the crushed honeycomb cells 98 at the depressions together (FIG. 7) U.S. Pat. No. 5,175,041, entitled Corner and Edge Protector for Packaging, describes the procedure for forming the corners 100 in greater detail.

Once the honeycomb material is folded at its depressions 102 and its ends brought together, the ring 28 so formed is fitted into the space between the side walls 74 of the sleeve 24 and the side walls 34 of the box 20. The corners 100 of the ring 28, of course. fit around the corners 76 of the sleeve 24 and into the corresponding corners 36 of the box 20. The ring 28 is urged downwardly through this space until it encounters the tabs 78 on the sleeve 24. Indeed, the tabs 78 support the ring 28 intermediate the package base 22 and the top wall 44 of the box 20. Here the honeycomb cells 98 lie perpendicular to the side walls 34 and 74 of the box 20 and sleeve 24 and keep the sleeve 24 centered within the box 20.

To enclose the compressor B within the package A, the box 20 is erected by bringing its corners 36 to their 90° orientation and then folding the bottom flaps 38 inwardly and securing them in the usual manner to form the bottom wall 40. Next the base 22 is fitted to the compressor B. Specifically, with the lower panel 54 of the base 22 folded outwardly from the upper panel 56 at the joints 60, the upper panel 56 is fitted over the shell 2 on the compressor B (FIG. 5). To this end, the cutout 64 in the upper panel 56 is aligned with the upper end of the shell 2, and oriented with one of the radial portions 66 or 68 being at the upper copper tube 10. The upper panel 56 is lowered over the shell 2 and past the upper tube 10 until it comes to the junction box 8, whereupon the upper panel 56 is rotated until its larger radial portion 66 of its cutout 64 aligns with the junction box 8. This brings the smaller radial portion 68 into alignment with lower and larger tube 12 on the compressor B. Thereupon, the upper panel 56 is lowered all the way to the relatively flat base 4 of the compressor B. Once the upper panel 56 reaches the compressor base 4, the compressor B is elevated or turned on its side so that the lower panel 54 of the package base 22 may be folded under the compressor base 4, which it is. In this regard, the package base 22 folds along the V-score joints 60 such that the lower panel 54 lies parallel to the upper panel 56 beneath the upper panel 56, with the compressor base 4 captured between the two panels 54 and 56 (FIG. 3). The short intermediate panel 55 lies at the ends of the two parallel panels 54 and 56 and provides enough separation between the two panels 54 and 56 to accommodate the thickness of the relatively flat compressor base 4.

With the package base 22 fitted to the compressor base 4, the compressor B is lowered into the box 20. The package base 22 slides along the interior surfaces of the side walls 34 on the box 20 until its lower panel 54 comes to rest on the bottom wall 40 of the box 20. The upper panel 56 lies above it with the compressor base 4 captured between the two panels 54 and 56.

Next the sleeve 24 is lowered into the box 20, where it passes over the shell 2 of the compressor B. It comes to rest on the package base 22 with its tabs 78 projecting toward opposite side walls 34 of the box 20 and its upper margins at the same elevation as the upper margins of the box 20. Then the honeycomb material is folded into the ring 28 (FIGS. 6 & 7), and the ring 28 is fitted into the space between the side walls 74 of the sleeve 24 and the side walls 34 of the box 20. The ring 28 descends until it comes to rest on tabs 78 of the sleeve 24 (FIG. 2). Also, the tray 26 is inserted into the upper end of the sleeve 24 and urged downwardly in the sleeve 24 until its center panel 86 comes to rest against the upper end of the compressor shell 2. The flaps on the tray 26 extend up to the upper margins of the side walls 74 on the sleeve 24.

Once the tray 26 is in place, instructional materials and accessories are loaded into it. Finally, with the tabs 78 on the sleeve 24 projecting laterally, the top flaps 42 of the box 20 are turned inwardly over the tabs 78 of the sleeve and are then secured in the traditional manner to form the top wall 44 of the box 20.

With the box 20 closed, the compressor B lies completely encapsulated in the package A. The package base 22 in which the compressor base 22 is captured keeps the compressor B from shifting laterally in the box 20. The sleeve 24, on the other hand, holds the two panels 54 and 56 of the package base 22 together, and this also keeps the compressor B from moving vertically in the box 20. The tray 26 further serves this end as well, in that its center panel 86 bears against the upper end of the compressor shell 2, and the flaps 88 extend up to the top wall 44. The ring 28, which fits around the sleeve 24 and within the box 20, stabilizes the upper end of sleeve 24 within the box 20. Since the sleeve 24 generally fits snugly over the compressor shell 2, the upper end of the shell 2 is confined and prevented from shifting laterally in the box 20. The sleeve 24, moreover, forms a protective layer around the compressor shell 2 and the junction box 8 and tubes 10 and 12 which project from it.

Figure 9:
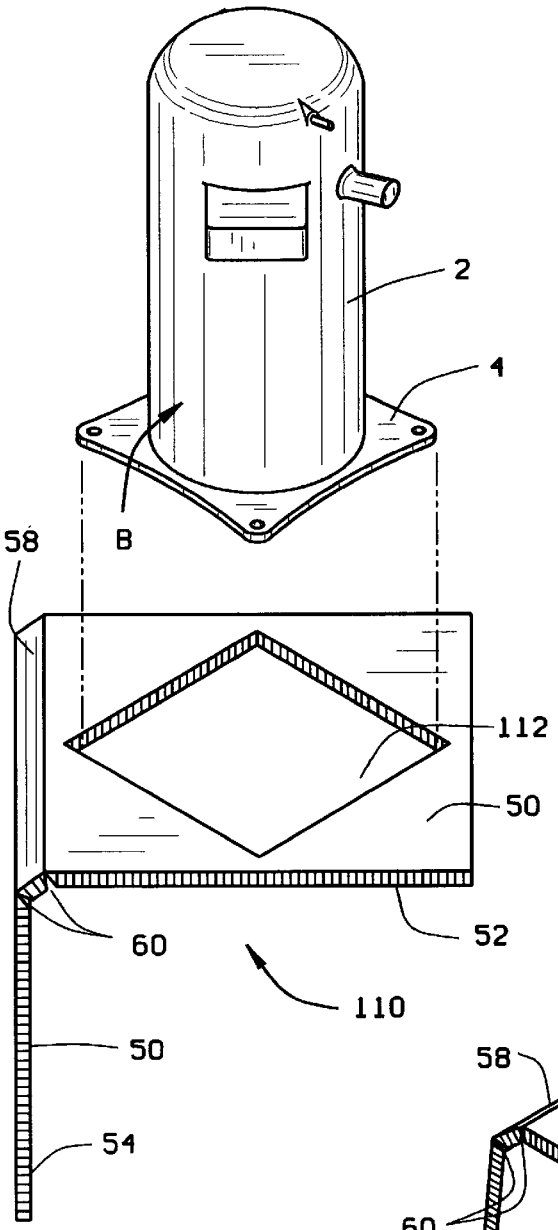
FIG. 9 is a perspective view showing a modified package base aligned for insertion over the compressor base.
Figure 10:
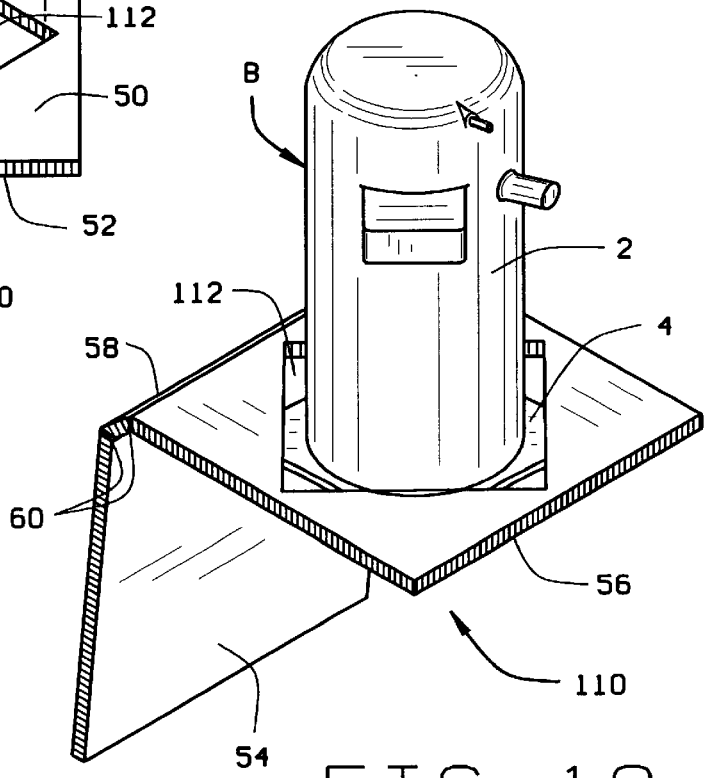
FIG. 10 is a perspective view of the modified package base fitted over and engaged with the compressor base.

A modified package base 110 (FIGS. 9 & 10) differs from the package base 22 in that it is configured to fit upwardly around the compressor base 4 and then, upon being rotated, lock onto the compressor B so that it is captured on the compressor base 4. To accommodate the modified package base 110, the compressor base 4 should possess a configuration.

More specifically, the modified package base 110, like the package base 22, has (FIG. 9) a lower panel 54, an upper panel 56 and an intermediate panel 58 which are joined together at V-score joints 60 to enable the panels 54 and 56 to fold easily relative to each other. Like the base 22, the base 110 is preferably formed from a slab material consisting of parallel facer sheets 50 which form the major surface areas of the panels 54, 56 and 58 and intervening sheets 52 that are oriented perpendicular to the facer sheets 50. The joints 60 and the intervening panel 58 enable the lower panel 54 to fold to a position parallel to the upper panel 56 and yet lie directly beneath the upper panel 56.

The upper panel 56 of the package base 110 contains a cutout 112, which may be rectangular, and it is large enough to enable the compressor base 4 to fit through it, although with relatively little clearance. But the orientation of the cutout 112 is such that it will not receive the compressor base 4 when the compressor B and package base are in the positions they occupy in the package A. On the contrary, the package base 110 must be rotated from that position in order for its cutout 112 to receive the compressor base 4.

On a packaging line, the compressor B may be suspended from an overhead conveyor with its base 4 presented downwardly. A worker takes a package base 110 and positions it such that its upper panel 56 is horizontal and its lower panel 54 simply depends from it in a somewhat vertical orientation. The worker then rotates and adjusts the position of the upper panel 56 of package base 110 until margins of the cutout 112 generally register with the margins of the compressor base 4—or at least until the cutout 112 is in a position that enables the compressor base 4 to pass through it. The worker elevates the package base 110, whereupon the upper panel 56 passes upwardly over the compressor base 4 with the cutout 112 in the upper panel 56 receiving the compressor base 4. Once the upper panel 56 is above the compressor base 4, the worker rotates the upper panel 56 so that its cutout 112 no longer registers with the compressor base 4. As a consequence, portions of the upper panel 56 lie over portions of the base 4 on the compressor B. Indeed, the worker rotates the package base 112 to the angular position that it normally assumes with respect to the compressor B when the base 112 and compressor B are in the box 20. Finally, the lower panel 54 of the base 112 is raised so that it swings upwardly, pivoting at the joints 60, until it underlies the compressor base 4. This captures the compressor base 4 in the package base 110.

Thereafter, the package base 110 and the compressor B are placed in the box 20, and the sleeve 24, ring 28 and tray 26 are installed in the manner previously described.

The modified package base 110 is particularly suited for compressors having larger junction boxes 8 or other components which hinder the easy passage of the upper panel 56 over the compressor shell 2. It works well with reciprocating compressors having bases formed from laterally directed feet.

This invention is intended to cover all changes and modifications of the example of the invention herein chosen for purposes of the disclosure which do not constitute departures from the spirit and scope of the invention.

What is claimed is:

1. A package for an object having a main body and a laterally directed base at the bottom of the main body, said package comprising: a box having side walls located around an interior, a bottom wall at the lower ends of the side walls and closing the interior at its lower end, and a top wall of the upper ends of side walls and closing the interior at its upper end; a package base located in the interior and having a lower panel and an upper panel, the lower panel being against the bottom wall of the box and the upper panel being over the lower panel and having a cutout therein large enough to enable the upper panel to fit around the body of the object, the upper panel being of a configuration that causes the package base to capture the base of the object between the upper and lower panels; a sleeve extending between the top wall and the upper panel of the package base for preventing the upper panel from moving away from the lower panel; and a ring located around the sleeve and being between the sleeve and the side walls of the box to stabilize the sleeve with the box.

2. A package according to claim 1 wherein the sleeve has side walls and outwardly directed tab; and wherein the ring rests on the tab.

3. A package according to claim 1 wherein the sleeve has side walls which lie parallel to the side walls of the box.

4. A package according to claim 1 wherein upper and lower panels of the base are joined together.

5. A package according to claim 4 wherein the lower and upper panels of the package base can fold with respect to each other where they are joined together.

6. A package according to claim 5 wherein the package base further includes an intermediate panel connected to the upper and lower panels along joints where the panels fold relative to each other.

7. A package according to claim 6 wherein the package base is formed from a honeycomb material having facer sheets and intervening sheets between the facer sheets, with the intervening sheets being generally perpendicular to the facer sheets; and wherein, at each joint between the intermediate panel and the lower and upper panels, one of the facer sheets is slit and the intervening sheets are crushed to provide V-shaped depressions which accommodate folds.

8. A package according to claim 5 wherein the cutout in the upper panel of the package base is large enough to receive the body of the object, but not the base of the object.

9. A package according to claim 5 wherein the cutout in the upper panel of the package base is large enough to receive the base of the object when the package base is in a selected angular orientation with respect to the object.

10. A package according to claim 1 wherein the ring is formed from a honeycomb material having paper facer sheets and paper intervening honeycomb cells between the facer sheets, with the axes of the cells being perpendicular to the facer sheets.

11. In combination with a compressor having a shell and a base attached to the shell at the bottom of the shell, with the base projecting laterally beyond the shell, a package for enclosing and protecting the compressor, said package comprising: a box having side walls located around an interior, a bottom wall at the lower ends of the side walls and closing the interior at its lower end and a top wall at the upper ends of the side walls and closing the interior at its upper end; a package base having a lower panel and an upper panel located over the lower panel, the lower panel being presented toward the bottom wall of the box and having the base of the compressor resting on it, the upper panel having a cutout therein which is configured to enable the upper panel to fit around the compressor and be over the compressor base, so that the compressor base is captured between the upper and lower panels; a sleeve located around the compressor shell and extending between the upper panel of the package base and the top wall of the box, whereby the upper panel of the package base is held against the compressor base.

12. The combination according to claim 11 wherein the lower and upper panels of the package base are joined together such that they can fold relative to each other.

13. The combination according to claim 12 wherein the cutout in the upper panel of the package base is large enough to receive the compressor base when the package base is at a selected orientation with respect to the compressor.

14. The combination according to claim 12 wherein the package base further includes an intervening panel located between the lower and upper panels and connected to the lower and upper panels along joints where the panels can fold relative to each other, the intervening panel being extended generally vertically along one of the side walls of the box.

15. The combination according to claim 14 wherein the package base is formed from a slab material having paper facer sheets which are spaced apart and intervening sheets located between and oriented generally perpendicular to the facer sheets.

16. The combination according to claim 15 wherein at each joint the facer sheet along the inside of the fold at that joint is severed in the direction of the fold and the intervening sheets are deformed into a V-shaped configuration to accommodate the fold.

17. The combination according to claim 16 wherein at each joint the intervening sheets are crushed to provide the V-shaped configuration.

18. The combination according to claim 11 wherein the package further comprises a ring which is located around the sleeve and extends laterally out to the side walls of the box to position the sleeve within the box.

19. The combination according to claim 18 wherein the sleeve has side walls from which at least one tab extends laterally outwardly; and wherein the ring rests on the tab.

20. The combination according to claim 18 wherein the package further comprises a tray which fits into the upper end of the sleeve and has a center panel extended immediately over the shell on the compressor and flaps directed upwardly from the center panel along the side walls of the sleeve, with the flaps having their upper ends against the upper wall.

21. The combination according to claim 11 wherein the compressor also has components which project laterally from the shell and the cutout in the upper panel of the package base is configured to accommodate the components as well as the shell.

22. The combination according to claim 21 wherein the sleeve is rectangular in cross-section and has corners, and one of the components projects toward one of the corners of the sleeve.

23. A method of enclosing a compressor having a shell and a base attached to the shell at the bottom of the shell, with the base projecting laterally beyond the shell, in a package including a box having side walls located around an interior, a bottom wall at the lower ends of the side walls and closing the interior at its lower end and flaps at the upper ends of the side walls, a package base having a lower panel and an upper panel hinged to the lower panel, with the upper panel having a cutout therein which is configured to enable the upper panel to fit around the compressor and yet lie over the compressor base, and a sleeve configured to fit over the shell of the compressor and into the box; said method comprising: fitting the upper panel of the package base over the compressor base with the compressor generally received in the cutout of the upper panel; folding the lower panel of the compressor base upwardly against the bottom of the compressor base so that the compressor base is captured in the package base; inserting the compressor with its base captured in the package base into the box such that the package base rests on the bottom wall of the box; fitting the sleeve over the shell of the compressor and into the box, with the sleeve rising to the upper end of the box; and folding the flaps of the box over onto the upper end of the sleeve.

24. The method according to claim 23 wherein the package further includes a ring; and further comprising inserting the ring around the sleeve such that it lies between the sleeve and the side walls of the box and is spaced from the package base.

25. The method according to claim 23 wherein the cutout in the upper panel of the package is large enough to receive the compressor base; and wherein the step of fitting the upper panel of the package base over the compressor base comprises passing the upper panel past the compressor base such that the cutout receives the compressor base, and adjusting the package base such that portions of the upper panel overlie the compressor base and the compressor base will no longer fit through the cutout.

* * * * *